US005740765A

United States Patent [19]

Ball et al.

[11] Patent Number: 5,740,765

[45] Date of Patent: Apr. 21, 1998

[54] ROTARY PISTON INTERNAL COMBUSTION ENGINE

[75] Inventors: Wilfried Ball, Dingolfing; Peter Rönnberg, Seeshaupt, both of Germany

[73] Assignee: Peter Pelz, Geretsried, Germany

[21] Appl. No.: 685,514

[22] Filed: Jul. 24, 1996

[30] Foreign Application Priority Data

Jul. 27, 1995 [DE] Germany ..... 195 27 396.6

[51] Int. Cl.[6] ..... F02B 53/00

[52] U.S. Cl. ..... 123/18 R; 123/18 A

[58] Field of Search ..... 123/18 R, 18 A

[56] References Cited

U.S. PATENT DOCUMENTS

| | | | |
|---|---|---|---|
| 1,778,182 | 10/1930 | Bullington | 123/18 A |
| 3,516,392 | 6/1970 | Morgan | 123/18 A |
| 3,644,069 | 2/1972 | Stewart | 123/18 A |
| 4,951,615 | 8/1990 | Pahis | 123/18 R |
| 5,203,287 | 4/1993 | Wiley | 123/18 R |
| 5,222,463 | 6/1993 | Farrell | 123/18 A |
| 5,363,813 | 11/1994 | Paarlberg | 123/18 R |

*Primary Examiner*—David A. Okonsky
*Attorney, Agent, or Firm*—Lalos & Keegan

[57] ABSTRACT

A rotary piston internal combustion engine includes a housing defining a cylinder chamber in the form of a circular ring. An even number of pistons circulate in the piston chamber and are of a circular cross-section adapted to the cylinder chamber. Two piston carriers mounted rotatably about the axis of the cylinder chamber each carry half the number of pistons, the peripheral surfaces of the piston carriers being such that they supplement the internal surface of the cylinder chamber to constitute a circular cross-section which corresponds to the pistons and against which piston rings on the pistons seal. At least one sealing ring is accommodated between the piston carriers and between each piston carrier and an oppositely disposed wall of the housing in an annular groove of the housing or a piston carrier respectively. The sealing ring bears against a co-operating surface of the respective piston carrier under a force which acts out of the annular groove.

9 Claims, 3 Drawing Sheets

ROTARY PISTON INTERNAL COMBUSTION ENGINE

FIELD OF THE INVENTION

The invention generally concerns a rotary piston internal combustion engine.

BACKGROUND OF THE INVENTION

A form of rotary piston internal combustion engine comprises a housing providing a cylinder chamber in the configuration of a circular ring. An even number of pistons is disposed in the cylinder chamber to rotate therein, the pistons being of a circular cross-section which is adapted to that of the cylinder chamber. Half of the pistons is fixed to respective ones of first and second piston carriers which are mounted rotatably about the axis of the ring configuration of the cylinder chamber. The peripheral surfaces of the piston carriers co-operate with the cylinder chamber to constitute a circular cross-section which corresponds to the pistons and against which piston rings on the pistons seal. At least one respective sealing ring is accommodated between the piston carriers and between each piston carrier and an opposite disposed wall of the housing, in an annular groove in the housing and a piston carrier respectively. Rotary piston internal combustion engines of that kind are provided with a control arrangement for controlling the rotary movement of the two piston carriers in such a way that during the rotary movement of the pistons in the cylinder chamber, working spaces which are formed within the cylinder chamber between two adjacent pistons associated with different piston carriers are alternately increased and reduced in size, the control arrangement performing a uniform rotary movement during the irregular rotary movement of the piston carriers. The angular position of the working spaces as they increase and decrease in size, relative to the cylinder chamber, is fixed. In the region of an increasing space the cylinder chamber is provided with at least one inlet opening while in the region of a decreasing space it is provided with at least one exhaust opening, between which an ignition or firing region is formed in the cylinder chamber. Within that region, the working spaces which rotate between the pistons assume a minimum volume and fire an ignitable mixture contained therein.

A rotary piston internal combustion engine of that kind is to be found for example in U.S. Pat. No. 3,890,939. In that internal combustion engine, sealing integrity between the housing and the piston carriers is afforded by sealing rings which are each arranged in respective annular grooves provided in mutually opposite relationship in the housing and the adjacent piston carrier or the two piston carriers respectively, and which depending on the radial pressure difference involved bear against the radially outward or the radially inward surfaces of those annular grooves. The sealing action achieved is heavily dependent on tolerances.

SUMMARY OF THE INVENTION

An object of the present invention is to provide a rotary piston internal combustion engine which enjoys reliable sealing integrity for the cylinder chamber thereof.

Another object of the present invention is to provide a rotary piston internal combustion engine which affords satisfactory sealing integrity while being of a simple reliably operating configuration.

Still another object of the present invention is to provide a rotary piston internal combustion engine in which sealing integrity within the engine is at least substantially independent of production tolerances.

In accordance with the principles of the present invention the foregoing and other objects are attained by a rotary piston internal combustion engine comprising a housing containing a cylinder chamber in the form of a circular ring, with an even number of pistons rotating in the cylinder chamber, the pistons being of a circular cross-section matched to the cylinder chamber. First and second piston carriers are mounted rotatably about the axis of the ring configuration of the cylinder chamber, half the number of pistons being fixed to each of the piston carriers. The peripheral surfaces of the piston carriers supplement the internal surface of the cylinder chamber to constitute a circular cross-section which corresponds to the pistons and against which piston rings on the pistons seal. At least one respective sealing ring is accommodated between the piston carriers and between each piston carrier and an oppositely disposed wall of the housing in an annular groove in the housing and a piston carrier respectively. A force acting out of the annular groove causes the sealing ring which is accommodated in the annular groove in the housing or one of the piston carriers to bear against a co-operating surface of the respective piston carrier.

The arrangement in accordance with the invention of the sealing rings and the biasing thereof towards the respective co-operating surface provides that only one annular groove is required for each sealing ring and the respective co-operating surface can be flat, that is to say without an annular groove, thus affording an arrangement which is substantially independent of production tolerances. The sealing ring can bear over a large area against the respective co-operating surface, which enhances the sealing action and also provides for the dissipation of heat if for example lubricant flows around the sealing ring at one side thereof. Production expenditure is also reduced by virtue of the fact that only one annular groove has to be provided for each sealing ring.

Further objects, features and advantages of the present invention will be apparent from the following description of preferred embodiments.

DESCRIPTION OF THE PREFERRED EMBODIMENTS

Figure 2:
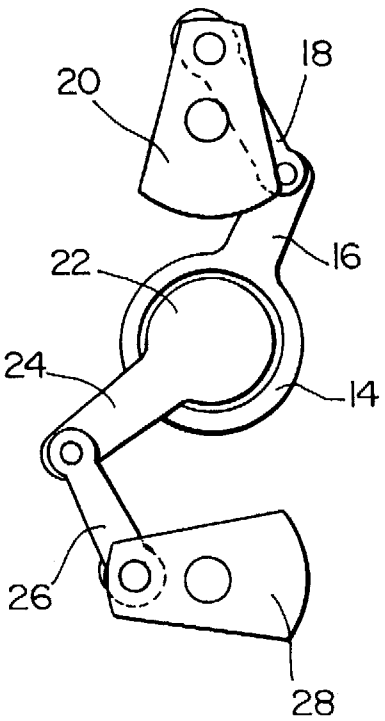
FIG. 2 is a view of the crank drive from the right in FIG. 1.
Figure 1:
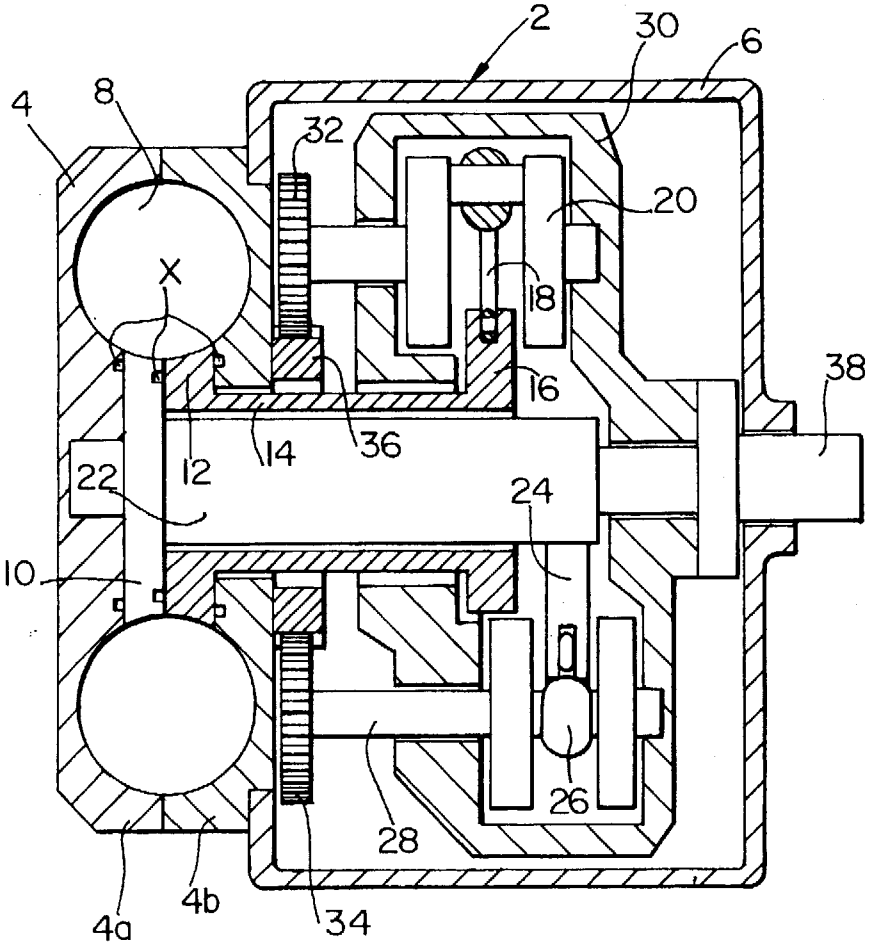
FIG. 1 is a view in longitudinal section through a rotary piston internal combustion engine according to the invention.

Referring firstly to FIG. 1, shown therein is a rotary piston internal combustion engine according to the invention having a housing which is generally identified by reference numeral 2 and which comprises an engine housing 4 and a drive housing 6. The engine housing 4 comprises two housing portions or shells **4*a*, 4*b* which include between then an inwardly open cylinder chamber 8 which is in the form of a circular ring, the housing portion 4a thereof being locked to the drive housing 2. A total of four pistons which are not shown in FIG. 1 rotate in the cylinder chamber 8. Of the pistons, each two are fixed in diametrally opposite relationship to a respective one of first and second piston carriers 10 and 12. The piston carriers 10 and 12 are provided towards the cylinder chamber 8 with peripheral surfaces such that they supplement the internal surface of the cylinder chamber 8** to constitute a circular cross-section. The one piston carrier forms a respective running surface for the pistons which are not fixed thereto.

The piston carrier 12 is non-rotatably connected to a hollow shaft 14 which projects into the drive housing 6 and which has a radial arm 16. The radial arm 16 is connected by way of a connecting rod 18 to a crankshaft 20.

Similarly the piston carrier 10 is rigidly mounted to a shaft 22 which extends within the hollow shaft 14 into the drive housing 6 and which terminates in a radial arm 24 which is connected by way of a connecting rod 26 to a crankshaft 28.

The crankshafts 26 and 28 are mounted in a crankcase 30 and terminate in gears 32, 34 which are non-rotatably connected to the crankshafts and which mesh with a gear 36 which is fixed with respect to the drive housing 6. The crankcase 30 is rotatable within the drive housing 6 and extends with an output shaft 38 through the drive housing 6.

The number of teeth on the gears 32, 34 and 36 are matched to each other in such a way that the crankshafts 20 and 28 rotate twice during one revolution of the crankcase 30 so that each working space formed between the pistons in the cylinder chamber 8 increases and decreases in size twice in the course of a complete revolution so that a four-stroke working cycle can be performed when the engine has an intake duct (not shown) and an exhaust duct (not shown).

Figure 3:
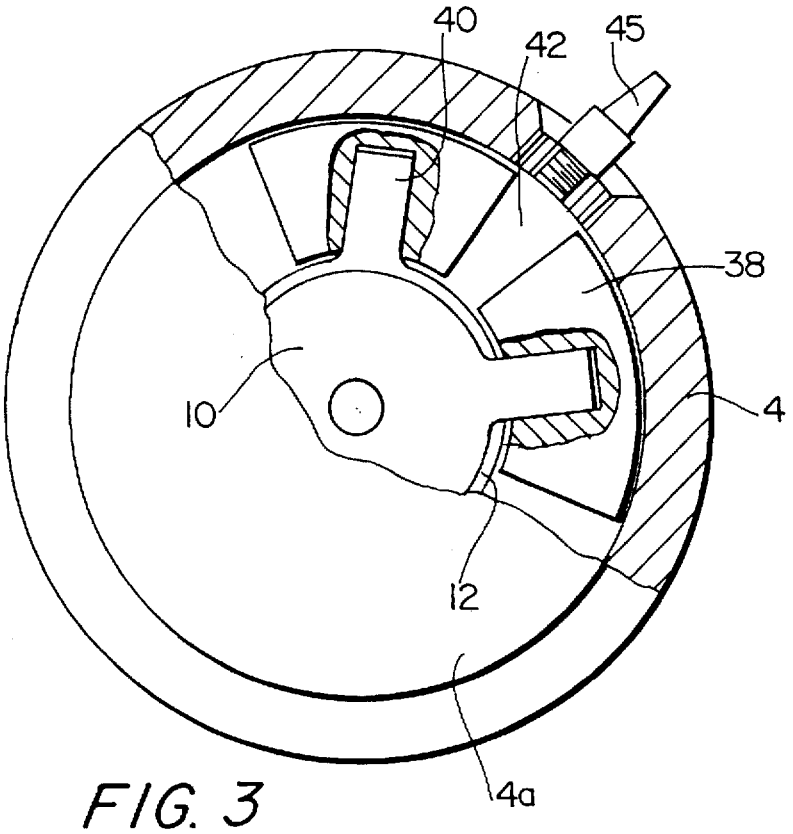
FIG. 3 is a view of the pistons with piston carrier, viewed from the left in FIG. 1.

FIG. 3 is a view from the left in FIG. 1 with the housing portion 4a partially cut away. That illustration shows the two piston carriers 10 and 12, with the diameter of the piston carrier 12 being shown somewhat enlarged, as well as a piston 38 and 40 fixed on respective ones of the piston carriers 10 and 12. The working space 42 enclosed between the pistons 38 and 40 is just at its minimum size and is in the region of a spark plug 45 which is provided when the internal combustion engine operates as an Otto engine.

Figure 4:
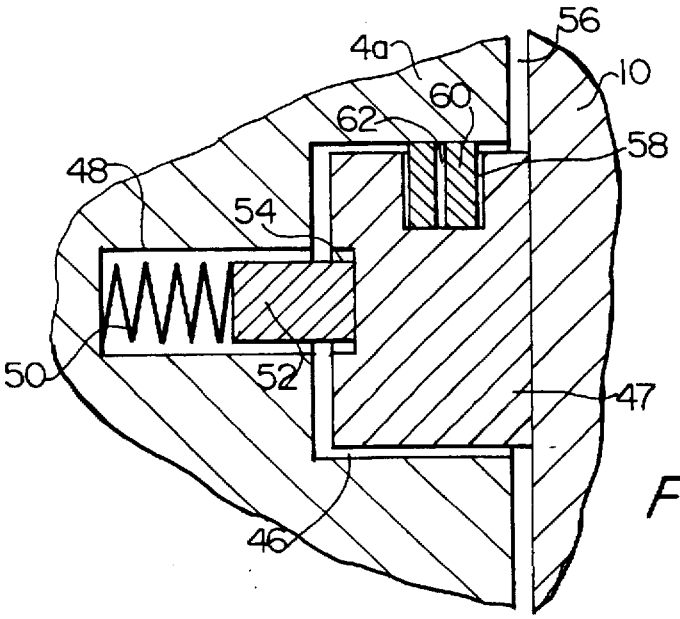
FIG. 4 shows an advantageous embodiment of a sealing arrangement between two movable parts.

Reference will now be made to FIG. 4 showing a configuration of a sliding ring seal as can be used at locations as identified by X in FIG. 1 between each two movable components, that is to say a housing portion and a piston carrier or between the two piston carriers. In the illustrated example the seal is disposed between the housing portion 4a and piston carriers 10. The housing portion 4a is provided with an annular groove 46 in which a sealing ring 47 acting as a sliding ring is disposed. The sealing ring 47 bears over a large area against the piston carrier 10, being fitted over a substantial part thereof into the annular groove 46. In order for the sealing ring 47 to be held non-rotatably in the housing portion 4a and in order for it to be pressed against the piston carrier 10, distributed over the periphery of the annular groove 46 are blind holes 48, in each of which is arranged a respective spring 50 which is illustrated in the form of a compression coil spring and which urges a pin 52 into a recess in the sealing ring 47. It will be appreciated that a pin 52 does not have to be provided in each of the blind holes 48 as the effect of preventing the sealing ring 47 from rotating relative to the housing portion 4a is already achieved for example by virtue of using three pins distributed at equal angular spacings. In order to provide that the sealing ring 47 is uniformly pressed against the piston carrier 10 it is advantageous for a plurality of springs 50, for example eighteen thereof, to be distributed uniformly around the periphery of the angular groove 46.

In order to provide for a reliable sealing action in relation to blowby gases which pass into the gap 56 between the housing portion 4a and the piston carrier 10 the sealing ring 47 is provided with a peripherally extending annular groove 58 into which two spring rings 60 and 62 which are operative as sealing rings are inserted in such a way that their gaps are turned relative to each other for example through 180°. The sealing rings 60 and 62 can be held non-rotatably by suitable means, for example by means of pins or by outward bulge portions in the bottom of the annular groove 58. The arrangement of the sealing rings 60 and 62 on the radially outer side has the advantage that lubricant coming from the shafts 14, 22 or from below in FIG. 4 can penetrate into the gap between the sealing ring 47 and the housing portion 4a so that it additionally assists with causing the sealing ring 47 to bear against the piston carrier 10.

It will be noted at this point that the described sealing arrangement provides an extremely good and reliable sealing integrity effect, with the contact over a large area between the sealing ring 47 and the piston carrier 10 additionally providing for cooling of the piston carrier. It will be appreciated that oil pressure which is applied to the arrangement from the left in FIG. 4 can also be used to press the sealing ring 47 against the piston carrier 10.

Figure 5:
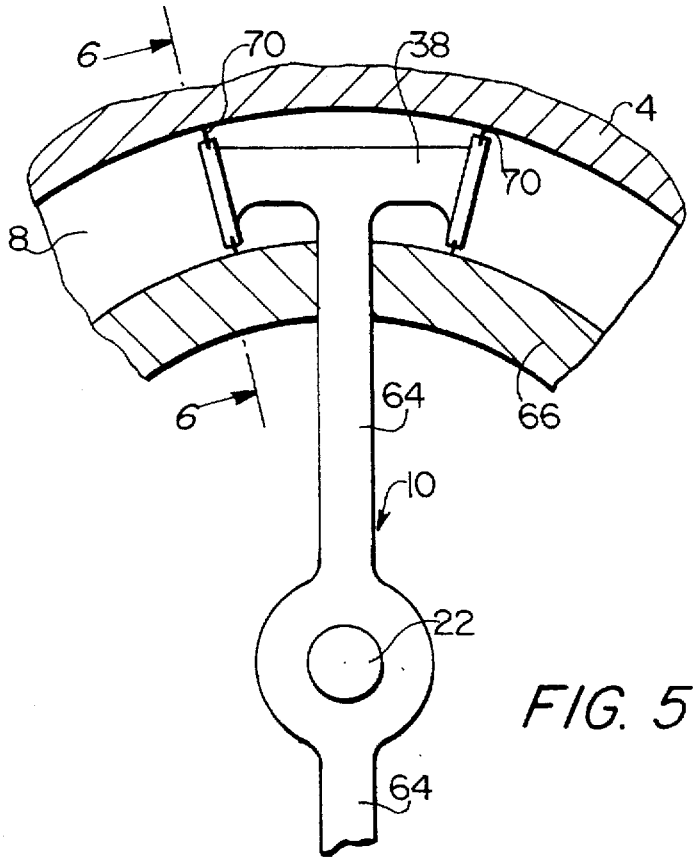
FIG. 5 is an axial view of a piston carrier with pistons.

Looking now at FIG. 5, the piston carrier 10 is fixed to the shaft 22 by way of an internal spline (not referenced). The piston carrier 10 includes two spokes 64 of which FIG. 5 shows only the upper spoke with the piston 38 formed integrally therewith at the radially outward end thereof. Mounted on the spoke 64 is an annular member 66 which rotates together with the piston carrier 22 and which, together with a corresponding annular member 68 carried on the other piston carrier 12, closes off the cylinder chamber 8 in a direction towards the shaft 22.

Figure 6:
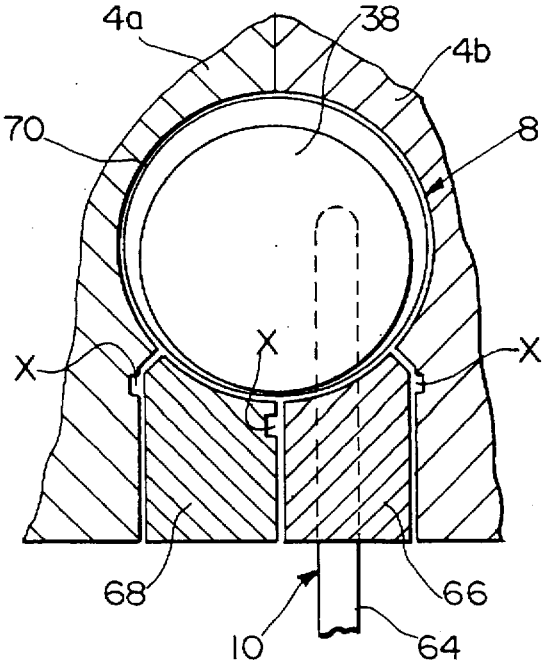
FIG. 6 is a sectional view of the arrangement shown in FIG. 5 in section taken along line VI—VI.

As can be seen now from FIG. 6 when the engine is in a condition of not being operationally hot, the piston 38 is disposed eccentrically relative to the cylinder chamber 8 so that when the temperature rises, as a consequence of expansion of its material and the material of the spoke 64, the piston 38 will move into a concentric position. Sealing integrity between the piston 38 and the inside wall of the cylinder chamber 8 is afforded by piston rings as indicated at 70.

It is advantageous if the piston carriers 10 and 12 comprise a material which has a lower coefficient of thermal expansion than the material of the engine housing 4 as the engine housing 4 can be directly water-cooled whereas the piston carriers can only be water-cooled with some difficulty.

The illustrated embodiment of the piston carrier 10 with the spokes 64 and the annular member 66 affords the following advantage:

Considerable centrifugal forces act on the piston 38 when it rotates in the cylinder chamber 8. In addition, the entire torque is transmitted from the piston 38 to the shaft 22 by way of the spokes 64 so that the spokes should consist of high-strength material. High-strength material of that kind generally has poor anti-friction properties which however are crucial in regard to the walls of the cylinder chamber 8. Therefore the annular members 66 and 68 are made from a material which has good anti-friction or sliding properties, for example coated aluminium or cast iron. It is also advantageous if the gap formed between the annular member 66, 68 and the associated engine housing portion or shell 4*b*, 4*a*, as shown in FIG. 6, passes perpendicularly into the cylinder chamber 8. As a result of that configuration, the arrangement does not have any sharp burrs, the piston rings 70 can reliably seal and the gaps can be sealed closer to the cylinder chamber 8, whereby leakage losses can be reduced.

It will be appreciated that the above-described constructions have been set forth solely by way of example and illustration of the principles of the present invention and that various other modifications and alterations may be made therein without thereby departing from the spirit and scope of the present invention.

What is claimed is:

1. In a rotary piston internal combustion engine comprising:

a housing containing a cylinder chamber in the form of a circular ring;

an even number of pistons rotatable in the cylinder chamber, the pistons being of a circular cross-section adapted to the cylinder chamber;

first and second piston carriers which are mounted rotatably about the axis of the ring configuration of the cylinder chamber and to each of which are fixed half the number of said pistons, the peripheral surfaces of the piston carriers being such that they supplement the internal surface of the cylinder chamber to constitute a circular cross-section which corresponds to the pistons;

piston rings on the pistons sealing in relation to the cylinder chamber; and at least one respective sealing ring accommodated between the piston carriers and between each piston carrier and an oppositely disposed wall of the housing in an annular groove in the housing and a piston carrier respectively;

the improvement that the sealing ring accommodated in the respective annular groove in the housing and one of the piston carriers bears against a co-operating surface of the respective co-operating piston carrier, acted upon by a force acting out of the annular groove.

2. A rotary piston internal combustion engine as set forth in claim 1 including a spring arranged between the bottom of the annular groove and the sealing ring.

3. A rotary piston internal combustion engine as set forth in claim 1 wherein a blind hole is disposed in the bottom of the annular groove and a recess is provided in the sealing ring, and including a pin means arranged in operative relationship with the blind hole and the recess to prevent the sealing ring from rotating.

4. A rotary piston internal combustion engine as set forth in claim 2 wherein the sealing ring has a radially outward surface within the annular groove and at said surface the sealing ring includes a peripherally extending groove, and further including at least one spring ring in the peripherally extending groove and sealing against the annular groove.

5. A rotary piston internal combustion engine as set forth in claim 4 including first and second spring rings arranged in the annular groove with their gaps displaced relative to each other.

6. A rotary piston internal combustion engine as set forth in claim 1 wherein a gap between each piston carrier and the adjacent surface of the housing opens at least substantially at a right angle into the cylinder chamber.

7. A rotary piston internal combustion engine as set forth in claim 1 wherein the piston carriers comprise a material with a lower coefficient of thermal expansion than the material of the housing.

8. A rotary piston internal combustion engine as set forth in claim 1 wherein each piston carrier has a hub, spokes which are connected to its hub and which comprise a high-strength material, and a ring portion which supplements the internal surface of the cylinder chamber, having a running surface of a material with good anti-friction properties.

9. A rotary piston internal combustion engine comprising: a housing containing a cylinder chamber in the form of a circular ring; an even number of pistons rotatable in the cylinder chamber, the pistons being of a circular cross-section adapted to the cylinder chamber; first and second piston carriers to each of which are fixed half the number of said pistons, the piston carriers having peripheral surfaces such that they supplement the internal surface of the cylinder chamber to constitute a circular cross-section which corresponds to the pistons; means mounting the piston carriers rotatably about the axis of the ring configuration of the cylinder chamber; piston rings on the pistons for sealing in relation to the cylinder chamber; at least one respective sealing ring accommodated between the piston carriers and between each piston carrier and an oppositely disposed wall of the housing; an annular groove for receiving the respective sealing ring; and a means adapted to apply a force acting out of the respective annular groove to the sealing ring to cause it to bear against a co-operating surface of the respective co-operating piston carrier.

* * * * *